United States Patent [19]

Redl

[11] Patent Number: 5,009,015

[45] Date of Patent: Apr. 23, 1991

[54] BRICK LINE TOOL

[75] Inventor: Robert F. Redl, Midland Park, N.J.

[73] Assignees: Louis J. Volpe, Jr., Wayne; Steven E. Wagner; Daniel L. Kurpick, both of Prospect Park, all of N.J.

[21] Appl. No.: 369,080

[22] Filed: Jun. 20, 1989

[51] Int. Cl.[5] ..... E04G 21/18

[52] U.S. Cl. ..... 33/409; 33/407

[58] Field of Search ..... 33/409, 408, 407, 406, 33/404, 403, 413

[56] References Cited

U.S. PATENT DOCUMENTS

| | | | |
|---|---|---|---|
| 847,824 | 11/1906 | Roberts . | |
| 1,094,286 | 4/1914 | Winstead | 33/409 |
| 2,505,606 | 4/1950 | Coffey | 33/409 |
| 2,663,938 | 12/1953 | Stodgell | 33/413 |
| 2,785,467 | 8/1954 | Andersen . | |
| 2,800,719 | 7/1957 | Tuzicka | 33/409 |
| 2,806,290 | 9/1957 | Tiefel | 33/408 |
| 2,834,112 | 10/1955 | Seagraves . | |
| 2,948,065 | 8/1960 | Simonic | 33/409 |
| 3,119,186 | 1/1964 | Stewart | 33/408 |
| 3,183,595 | 4/1961 | Jopperi . | |
| 3,461,565 | 8/1969 | Harris | 33/408 |
| 3,626,434 | 12/1971 | Miller | 33/408 |
| 3,729,828 | 5/1973 | McKenzie . | |
| 3,765,096 | 10/1973 | Simmons et al. | 33/409 |
| 4,422,241 | 12/1983 | Meeker | 33/563 |

FOREIGN PATENT DOCUMENTS

| | | | |
|---|---|---|---|
| 556470 | 4/1958 | Canada | 33/413 |
| 1136354 | 12/1968 | United Kingdom | 33/404 |

*Primary Examiner*—William A. Cuchlinski, Jr.
*Assistant Examiner*—C. W. Fulton
*Attorney, Agent, or Firm*—Weingram & Zall

[57] ABSTRACT

A pair of flat plates with two rectangular sides provide corner pieces which fit over the top edges of bricks at opposite ends of a structure. Each plate includes a raised tab and extending finger which receive a line or string to be held taut between the two end pieces. The string serves as a linear guide for laying bricks in a straight line between the two ends. The device provides a simplified tool which saves time and effort in achieving the desired linear brick construction.

6 Claims, 1 Drawing Sheet

BRICK LINE TOOL

BACKGROUND OF THE INVENTION

Field of the Invention

The present invention relates to a tool for laying bricks in a straight line and particularly to an improved simplified configuration therefor.

DESCRIPTION OF THE PRIOR ART

Previous devices for aligning bricks along a structure included the use of levels, strings tied between nails hammered into end bricks, and guides secured to opposite ends of the structure to be built. Examples of such prior art devices are shown in U.S. Pat. Nos. 3,183,595, 2,834,112, and 847,824, which devices engage only the ends of opposite side walls. U.S. Pat. No. 2,785,467 shows a tool with two flat top and front rectangular plates and two side walls which fit over opposite corner bricks. Holes in the sharp bend between the flat plates hold a line used as the guide for laying bricks. U.S. Pat. Nos. 3,729,828 and 847,824 show tongues that are used for holding guidelines and the latter also shows an extending finger which is used to hold and move the device. These devices, however, did not provide the simplified, more efficient configuration that is incorporated in the present tool.

SUMMARY OF THE INVENTION

It is, therefore, the primary object of the present invention to provide an improved tool for aligning bricks in a rapid, efficient manner.

It is another object of the invention to provide a simplified brick line tool which engages the top and side surfaces of end bricks.

A further object of the invention is to provide a brick line tool which includes a simplified structure for holding a guideline.

These objects are achieved with a novel structure including a flat plate having two rectangular sides providing a corner piece which fits over the top surface and two sides of a corner brick. A central raised tab and a finger extending from an inner corner of the flat plate receive and secure the line or string which is held taut between symmetrical corner pieces at opposite ends of the brick wall. The string provides a guideline for laying bricks in a straight line between the two opposite corner bricks.

Other objects and advantages will become apparent from the following description in conjunction with the accompanying drawings.

DESCRIPTION OF THE PREFERRED EMBODIMENT

Figure 1:
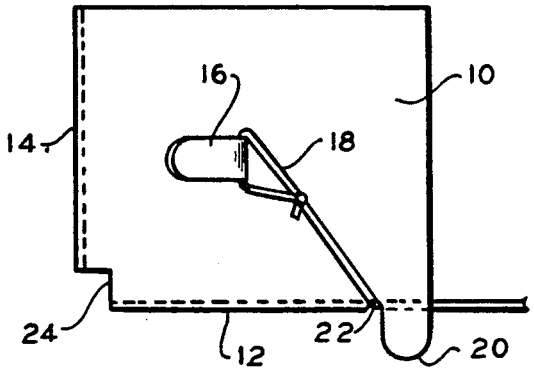
FIG. 1 is a plan view of the left-hand corner plate of a pair of brick line tools showing the central raised tab, a finger extending from one side, and a guideline secured thereon.
Figure 2:
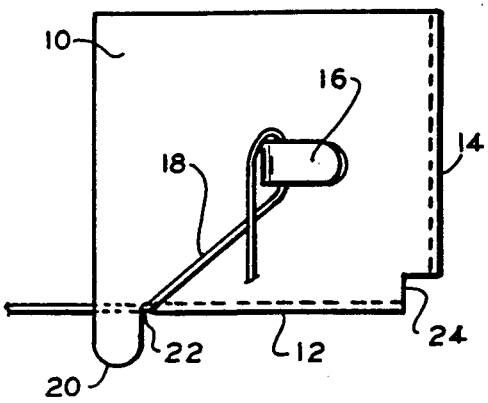
FIG. 2 is a plan view of the right-hand corner plate symmetrical to that of FIG. 1.
Figure 3:
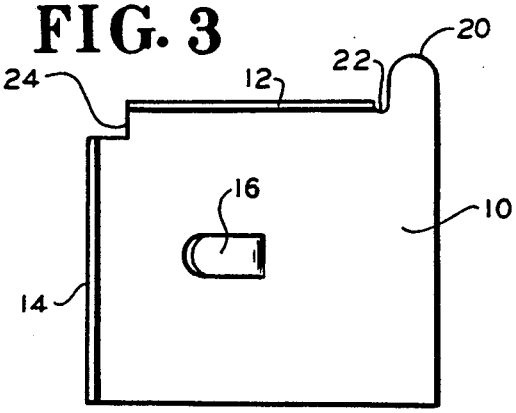
FIG. 3 is a bottom view of the corner plate of FIG. 1.
Figure 4:
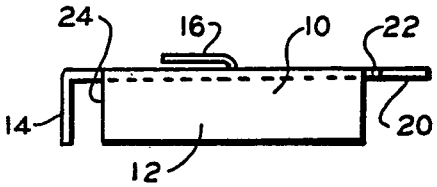
FIG. 4 is a front view of the corner plate of FIG. 1.
Figure 5:
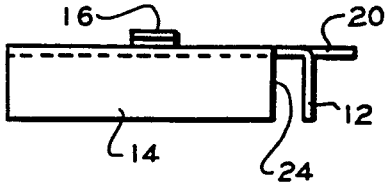
FIG. 5 is a side view of the corner plate of FIG. 1.

As shown in the figures, a flat rectangular plate 10, of a suitable metal or plastic material, is adopted to be positioned on the top surface of a brick at an end or corner of a structure to be built. The plate has two relatively short rectangular front and side walls 12, 14, extending vertically downward from the top to engage the front and side faces of the corner brick. A central raised tab 16 formed from a cut in the plate 10 extends outwardly toward side 14 and provides a narrow space between the tab and surface of the plate to receive a string or guideline 18. The string is held in place and wedged in the narrow space between the tab and plate close to the point at which the tab joins the plate. The string may be wrapped around the tab or secured in any suitable manner and then led along the top of the plate toward a finger 20 extending outwardly from the edge of the plate at the inner corner above side 12. A small notch 22 in the edge adjacent finger 20 facilitates holding and guiding the string under finger 20 and outwardly toward the symmetrical right-hand plate at the opposite end of the brick structure. A like finger, notch and tab guide and hold the string at the other end with the string being stretched taut and secured tightly around the tab to provide a straight line between the two ends to serve as a guide for laying the bricks. A further cut out section 24 removes the outer corner portion of plate 10 and sides 12 and 14 to facilitate positioning the plate at the corner edge of the brick. The extreme end of the brick is visibly exposed to aid in the proper positioning of the plate to ensure the desired linear guideline arrangement.

Figure 7:
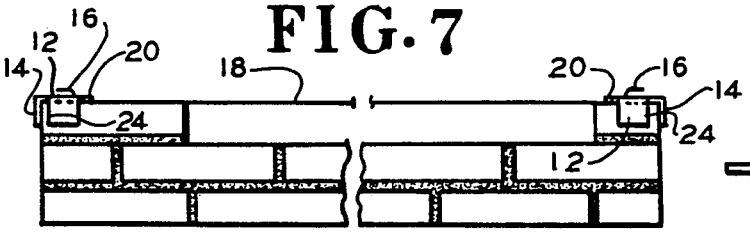
FIG. 7 is a front view of a brick structure showing the pair of corner plates at opposite ends and a guideline held between the two ends.
Figure 6:
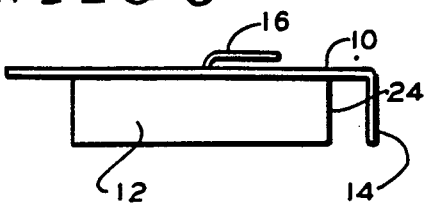
FIG. 6 is a back view of the corner plate of FIG. 1.
Figure 8:
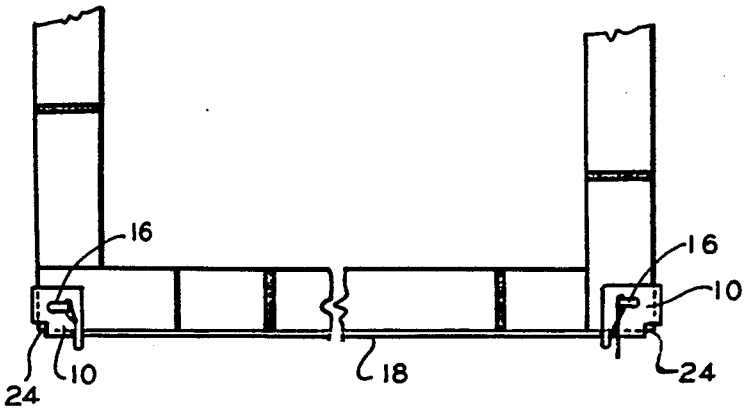
FIG. 8 is a plan view of a brick structure showing the pair of corner plates at opposite ends and a guideline between the two ends.

In use, as shown in FIGS. 7 and 8, the two symmetrical rectangular plates are positioned on the top and sides of the corner bricks at opposite ends of a row of bricks to be laid in a straight line. The plates are placed to fit closely and squarely over the rectangular faces of the bricks with the corners visible through the cutout portions of the plates. The string is wrapped around the tab at one end and guided into the small notch and under the finger toward the plate at the opposite end where it is pulled and similarly secured tightly to hold the line taut and straight. The string then provides a guideline to permit laying of the bricks and mortar in a straight line between the two ends. The same procedure is followed for each row of bricks until the desired structure is completed. The guide plates can be utilized for various brick structures including walls, steps, patios, fireplaces, and window sills. The bricks may also be aligned in vertical, horizontal, or angular directions. while only a single embodiment has been illustrated and described, many variations may be made in the particular design and configuration without departing from the scope of the invention as set forth in the appended claims.

What is claimed is:

1. A tool for aligning bricks comprising:

a first flat top plate having a front wall and a side wall extending downwardly at right angles from said plate for engaging the top face, the front face and one side face of a brick;

a finger extending forwardly from a front edge at the inner corner of said top plate adjacent the inner end of said front wall and including a notch in said top plate front edge between said finger and adjacent end of said front wall for holding a guideline;

a raised tab cut from a portion of said top plate and extending outwardly along said plate, said tab providing a narrow space above said top plate to receive and hold one end of said guideline therein; and the outer end of said front wall being spaced from said side wall and the front end of said side wall being spaced from said front wall including a cut-out section in the outer corner of said top plate and in said front and side walls for receiving and exposing the outer corner of said brick, said tool being positionable over the outer corner of said brick so that said corner of said brick extends into said cut-out section.

2. The tool of claim 1 wherein said finger extends from said inner corner of said top plate in the plane of said plate.

3. The tool of claim 1 wherein said raised tab is in a central area of said top plate and extends toward said side wall.

4. The tool of claim 1 including a second flat top plate with front and side walls, a finger, and a raised tab symmetrical to said first flat top plate to receive and hold the other end of said guideline.

5. The tool of claim 4 wherein said symmetrical plates are adapted to be positioned over the top and sides of bricks at opposite corners of a structure, the ends of said guideline being secured to respective said plates and stretched taut therebetween to form a straight line for aligning bricks.

6. The tool of claim 1 wherein said top plate has only one front wall and only one side wall for engaging a corner of an end brick.

* * * * *